United States Patent [19]

Graham et al.

[11] Patent Number: 4,838,005

[45] Date of Patent: Jun. 13, 1989

[54] STAIRWAY APPARATUS AND METHOD OF MANUFACTURE

[75] Inventors: James M. Graham, Myrtle Beach; Edward F. Schaack, Greenville, both of S.C.

[73] Assignee: Duraflite, Inc., Danbury, Conn.

[21] Appl. No.: 929,826

[22] Filed: Nov. 13, 1986

Related U.S. Application Data

[60] Division of Ser. No. 799,270, Nov. 18, 1985, abandoned, which is a continuation-in-part of Ser. No. 745,434, Jun. 17, 1985, abandoned.

[51] Int. Cl.[4] ..... E04B 1/00

[52] U.S. Cl. ..... 52/741; 52/188; 52/189; 52/191

[58] Field of Search ..... 52/182, 189, 190, 191, 52/184, 185, 188, 741

[56] References Cited

U.S. PATENT DOCUMENTS

| | | | |
|---|---|---|---|
| 1,593,360 | 7/1926 | Richmond et al. | 52/191 |
| 1,679,570 | 8/1928 | Hall | 52/191 |
| 1,684,766 | 9/1928 | Hedeen | 52/191 |
| 1,789,969 | 1/1931 | Davis | 52/191 |
| 1,862,958 | 6/1932 | Hall | 52/191 |
| 2,205,859 | 6/1940 | O'Donnell | 52/188 |
| 2,949,703 | 8/1960 | Katzmarek | 52/188 |
| 3,257,761 | 6/1966 | Klein | 52/191 X |
| 3,670,848 | 6/1972 | Raguel, Jr. | 52/185 X |
| 3,707,814 | 1/1973 | Seegers | 52/185 |
| 3,720,024 | 3/1973 | Theisen | 52/185 |
| 3,896,650 | 7/1975 | O'Konski | 72/186 |
| 4,039,345 | 8/1977 | Emig et al. | 106/90 |
| 4,244,154 | 1/1981 | Weaver | 52/185 |

FOREIGN PATENT DOCUMENTS

| | | | |
|---|---|---|---|
| 522121 | 8/1953 | Belgium | 52/191 |
| 804041 | 2/1951 | Fed. Rep. of Germany | 52/191 |

*Primary Examiner*—Carl D. Friedman

*Attorney, Agent, or Firm*—Lawrence Hager

[57] ABSTRACT

Stair apparatus and method of manufacture, wherein the stair apparatus has concrete tread pads and landings which are poured and set during manufacture so that pouring and setting of the concrete does not have to be done in the field, thereby saving much labor and time. The method includes a unique step of clamping the step elements between the stringer elements so that the step elements are firmly held in proper position during welding thereof to the stringer elements. The landings are supported in a novel manner in a stairwell, and the stair assemblies are supported between the landings.

6 Claims, 4 Drawing Sheets

STAIRWAY APPARATUS AND METHOD OF MANUFACTURE

This is a division of application Ser. No. 799,270, filed Nov. 18, 1985, now abandoned, which is a continuation-in-part of application Ser. No. 745,434, filed June 17, 1985, now abandoned.

BACKGROUND OF THE DISCLOSURE

The metal stairways customarily provided have concrete treads and landings which are poured in the field, i. e. at the location at which the stairways and landings are installed. Pouring of the treads and landings in the field presents problems. The stairways are usually in elevated and confined locations, making it difficult to deliver concrete to their locations, and making it difficult to properly pour and finish the concrete and to clean up after pouring is completed. In addition to the difficulties of pouring and finishing the concrete of stair treads and landings in the field, it is usually relatively expensive, as well. This invention seeks to avoid the problems associated with the pouring and finishing of stair treads and landings in the field, by providing methods for manufacture and products wherein the stair treads and landings are poured and finished at the point of manufacture, to be delivered to the job site for installation without any pouring and finishing of the concrete treads and landings being necessary. Much time and labor is also saved by use of the method and apparatus provided by the invention.

SUMMARY OF THE INVENTION

The invention provides methods for manufacture of metal stairs wherein the concrete treads and landings are poured and set at the manufacturing location. The methods include methods for welding tread pan and riser units to the angular stringers in a simple and efficient manner. The concrete treads and landings are of special composition in order that the finished stair units may be moved, transported and stored without breakage or other damage to the unit. The tread pan and riser units are welded to the stringers and to one another, so that the resulting stair units are strong and easily handled and installed, with the tread concrete already in place. The concrete is firmly secured in the tread pans by an adhesive material, so that there is no danger that the concrete tread pads will become loosened or dislodged during installation or during use. The stair structures meet all building codes and do not require special approval for use. The units have high weight bearing capability, being stronger than the units currently in use.

The invention also provides landings of new and novel designs, formed of concrete poured at the factory, supportable in the stair wells in a simple efficient manner, and capable of supporting flights of stairs therebetween without any additional support equipment.

A principal object of the invention is to provide stair units which have the concrete tread pads and landings poured at the manufacturing location, so that pouring of the tread pads and landings in the field is not necessary. Another object of the invention is to provide such stair units which are strong and safe and which meet all applicable building and fire codes. A further object of the invention is to provide such stair units wherein the concrete tread pads are bonded in place. Yet another object of the invention is to provide improved methods for manufacture of stair units of the type described. A further object of the invention is to provide such stair units which are economical in manufacture and use, and for which the installation costs are significantly reduced and installation simplified. Still another object of the invention is to provide such stair units wherein the concrete tread pads and landings are of improved composition, to be of improved strength and utility. An additional object of the invention is to provide such stair units which represent a significant advance in the art. Other objects and advantages of the invention will appear from the following descriptions of preferred embodiments of the methods and apparatuses, reference being made to the accompanying drawings.

DESCRIPTION OF THE PREFERRED EMBODIMENTS

Figure 1:
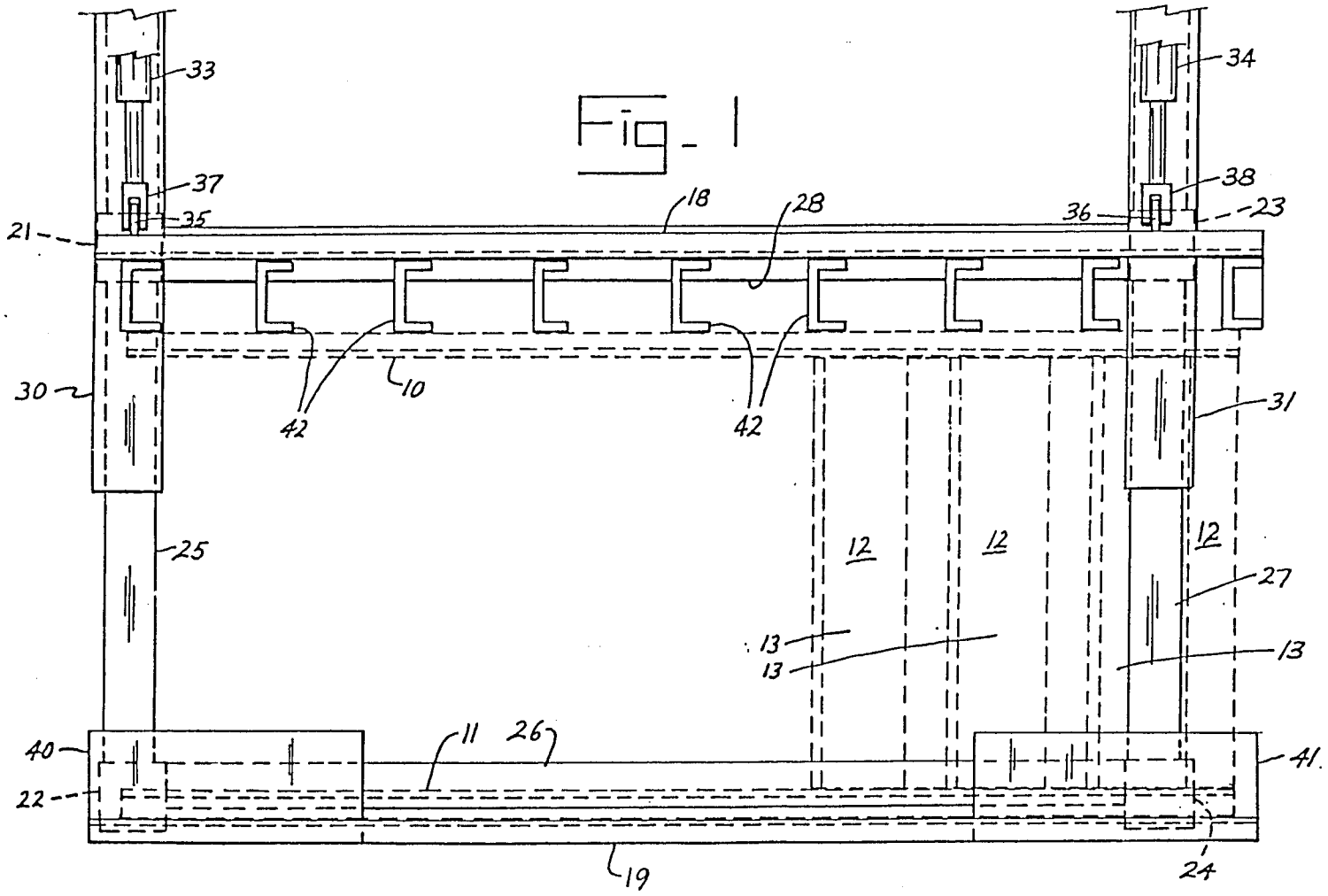
FIG. 1 is a plan view of an apparatus used in manufacture of apparatus of preferred form according to the preferred methods of the invention.

Referring to the drawings in detail, the first primarily to FIG. 1, the first apparatus to be described in detail will be the apparatus used for assembly of the metal structures of the apparatus. Each stair assembly includes a pair of side beams, called "stringers", which in this case are each of channel form. The stringers are supported angularly in a staircase, and the tread pan and riser elements are welded at each end to them. In FIG. 1, the two channel stringers are designated by reference numerals 10, 11 and are shown by dashed lines in order to distinguish them from the apparatus used in making the assembly.

The edge flanges of the two stringer channels are disposed outwardly, as shown. A number of tread-riser elements 12, three being shown in FIG. 1, are connected parallely side by side between stringers 10,11. Each element 12 includes a tread pan portion 13, having a frontal flange 14 and inturned flange 15 (see FIG. 4), to form with the riser 16 a concrete containing pan space. The riser panel 16 is canted or angular as shown best in FIG. 4, in order to increase the tread area somewhat. It should be clear, that if the riser were vertical, the widths of the tread pans and treads would be decreased.

A pair of outer channels (FIG. 1) are disposed with their lengths horizontal, these being referred to by reference numerals 18, 19. Four posts shown as having square cross sections, reference numerals 21–24 are connected and braced by beams 25, 26, 27, 28. Additional posts and beams may be included as necessary to adequately support the apparatus. Channels 18, 19 are supported across the tops of posts 21, 23 and 22, 24, by welding or other suitable connections. The channels have their edge flanges disposed outwardly, as indicated in the drawing. On each of the posts 21, 23 there is disposed a horizontal channel 30, 31, these being between the upper end of the post and the outer channel 18 and having their edge flanges turned downwardly. Channels 30, 31 extend inwardly of channel 18, to form platforms on which stringer 10 may be supported, and extend outwardly beyond channel 18, as shown.

At the outer ends of channel 30, 31, not shown, there are supported the outer ends of cylinders 33, 34, the cylinder shafts being connected to brackets 35, 36 fixed to channel 18 by yokes 37, 38 which are carried at the shaft ends. Suitable cross pins or bolts connect the yokes to the brackets. When the shafts of the cylinders are extended by introduction of fluid into the outer ends of the cylinders, the channel 18 is moved inwardly, and when the shafts of the cylinders are retracted by introduction of fluid into the inner ends of the cylinders, the channel 18 is moved outwardly. In both movements, the channel slides along the channels 30, 31.

The channel 19 is fixed in place across posts 22, 24, there being a short channel 40, 41 fixed between the top of the post and channel 19 in the position shown to form platforms for support of stringer 11.

A plurality of vertically disposed channels 42 are shown welded to the face of channel 18, these serving as spacers so that channel 10 is inward of the position in which it would be if the spacers were not present and channel 10 were against channel 18. For stair assemblies wider than the assembly herein described, the spacer channel 42 can be ommited or made narrower, and for stair assemblies narrower than the assembly herein described, the spacer channels can be made wider. Other structures than channels may be used to adjust the spacing between channels 18, 19.

Figures 2, 3, 4:
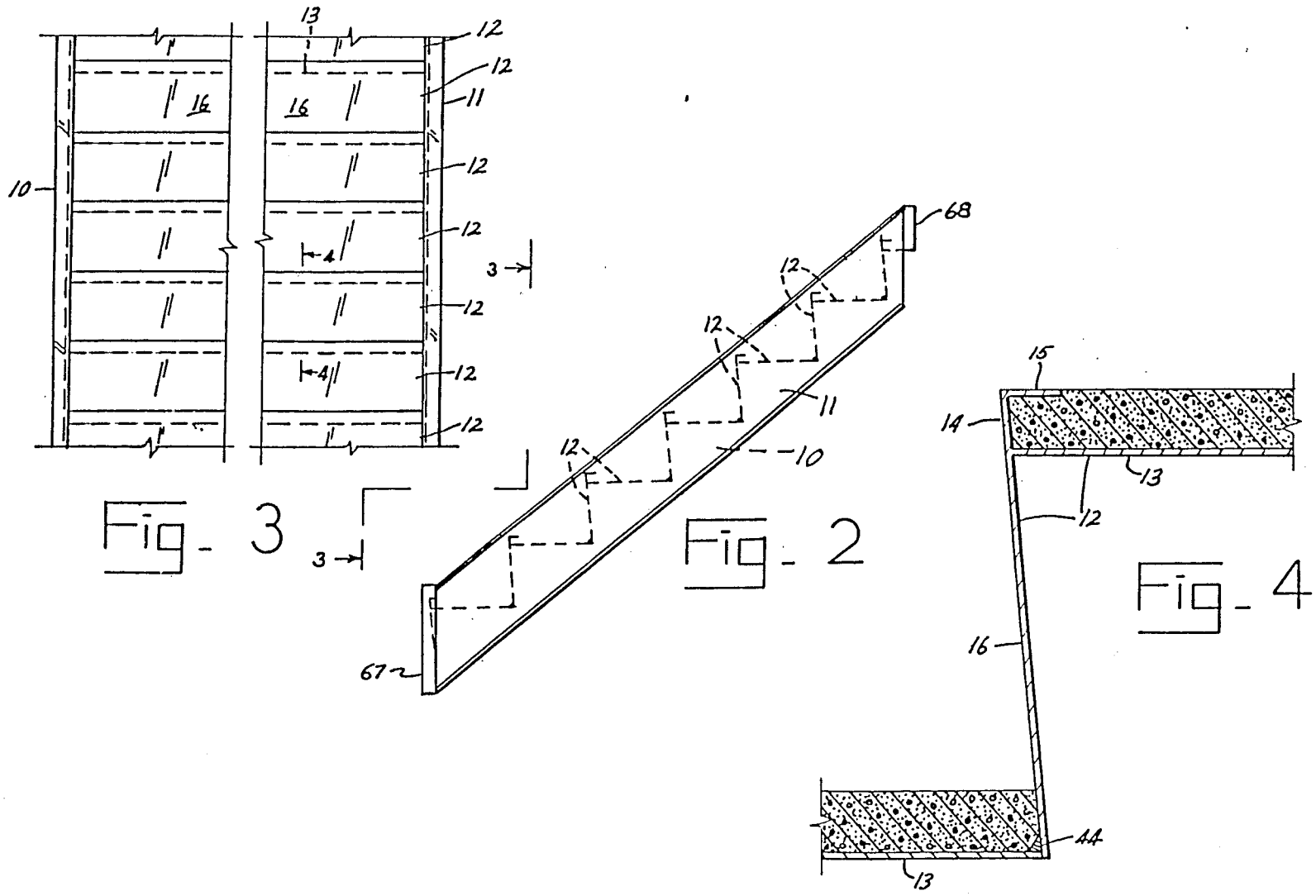
FIG. 2 is schematic side elevation of an apparatus of preferred form according to the invention.
FIG. 3 is a partial elevation taken at line 3—3 of FIG. 2.
FIG. 4 is a vertical partial cross section taken at line 4—4 of FIG. 3.

To manufacture a stair assembly **10*a* through use of the apparatus shown in FIG. 1, the two stringer channels are placed across channels 30, 31 and channels 40, 41 at opposite sides of the space between channels 18, 19. Tread pan-riser elements are placed, one at a time, between the channels 18, 19, adjusted in position, and clamped in place by operation of cylinders 33, 34 to drive the cylinder shafts inwardly, thereby pressing channel 18 (or spacers affixed thereto) against the outer side of the stringer 10, to clamp the tread pan-riser element firmly in place between channels 18, 19. The clamped element is next welded at opposite ends to the channels, it being preferred to first connect a tread pan-riser element at one end of the stringers. Another element is then placed against the first element, clamped, and welded not only at its ends but also to the first installed tread pan-riser element. This procedure is repeated for each tread pan-riser element until all of these elements have been welded in place to the stringers and to one another. A weld 44, FIG. 4, is shown to show the locations of the welds between tread pan-riser elements. The welds 44** are covered by concrete when the structure is completed, as will be described. Once the elements have been welded between the stringers, the entire structure becomes relatively rigid.

The next procedure in manufacture of the stair apparatus is to fill the tread pans with concrete, and to finish the upper surface of each tread. The first step is to paint or smear an adhesive onto all of the interior surfaces of the tread pan. For this purpose, an adhesive such as the epoxy, Thermal-Chem Wet Concrete Bonder #501, is preferred. Other epoxy or other bonding agents may be used if found satisfactory. Before the epoxy or other bonding agent has set, the tread pan is filled with a wet concrete mixture, and the surface of the concrete leveled and smoothed or textured to provide the type of tread surface desired. Then the concrete is allowed to set. Each tread pan of the assembly is completed in the same manner.

The wet concrete mixture may be of a range of compositions, but a mixture such as the following is preferred in order to achieve optimum results from the invention:

Dry Concrete Mix Proportions:
Sand: 450 pounds
Stone: 600 pounds
Fibermesh: 5 ounces
Airflex RP245: 4 pounds
Chem-Comp 111: 10 pounds
Calcium Aluminate Cement: 20 pounds
Gray Portland Cement: 170 pounds.

A dry concrete mixture as above, or comparable substitute, is mixed in a mechanical mixer with water addition to a slump of 3" to 4". After the wet concrete mixture is placed in the tread pan, it should be vibrated to consolidate the mixture and then struck off to the desired level. When the surface water disappears, the surface should be finished with a steel trowel for interior applications, or, for exterior applications, the surface is finished with a stiff broom to obtain a textured nonskid surface. Other textured or decorative finishes may be applied.

After the concrete has set, it is bonded firmly as a slab within the tread pan, and is very tough and durable and capable of withstanding large loads and severe impacts. The stair unit, tread pan-risers and stringers and concrete treads, may be stored and transported as an integrated finished assembly for installation as part of a completed stairway structure, without any finishing of the assembly being necessary, except painting of the metal parts for decorative and protective purposes if desired. The metal parts may be prepainted at the factory if desired, with corrosion resistant or other paint. The concrete tread pads may, if desired, be colored with a pigment or other coloring medium, or may be painted.

In the dry concrete mixture described above, the sand is a type ordinarily used in concrete mixtures, and the stone is subdivided as is customary in concrete mixtures. Fibermesh is a single filament synthetic fiber which increases impact resistance of the concrete and reduces abrasion, as well as controlling cracks. Airflex RP245 is a redispersible powder based on a vinyl acetate ethylene copolymer, and has resistance to alkali degradation. It is a hydrating agent in the concrete mixture, and has binder capability. Chem-Comp III is a shrinkage compensated cement which prevents the tread pads from shrinking during setting of the concrete. Calcium aluminate cement adds strength to the tread pads. Gray Portland cement is standard cement customarily used for concrete construction.

Figure 5:
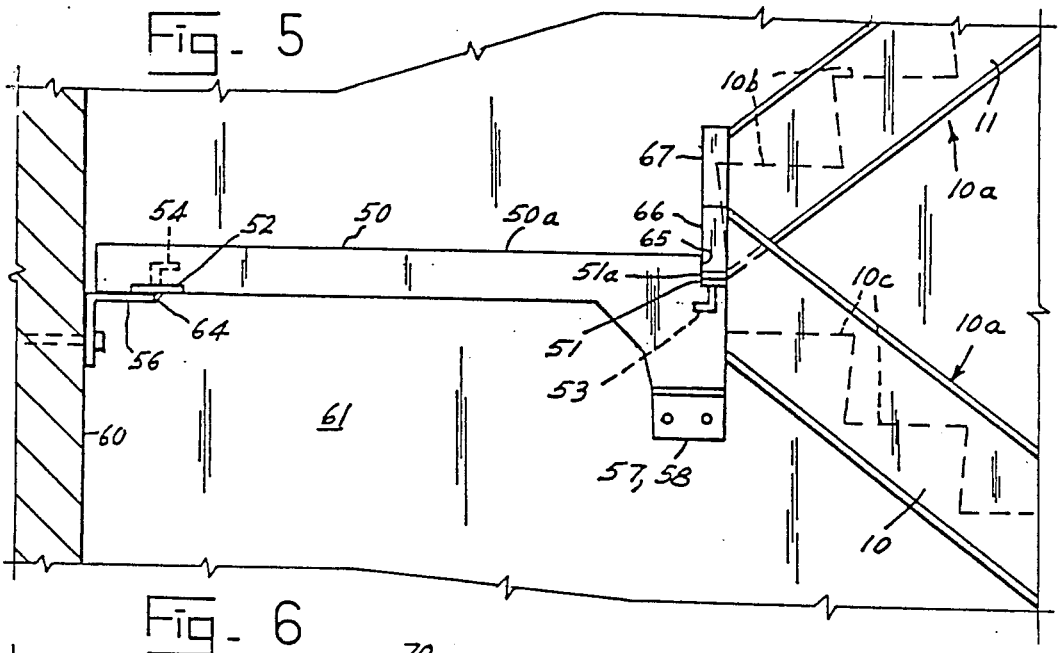
FIG. 5 is a side elevation, partly in vertical cross section, showing a stairway landing structure forming a part of the stair apparatus according to the invention.
Figure 6:
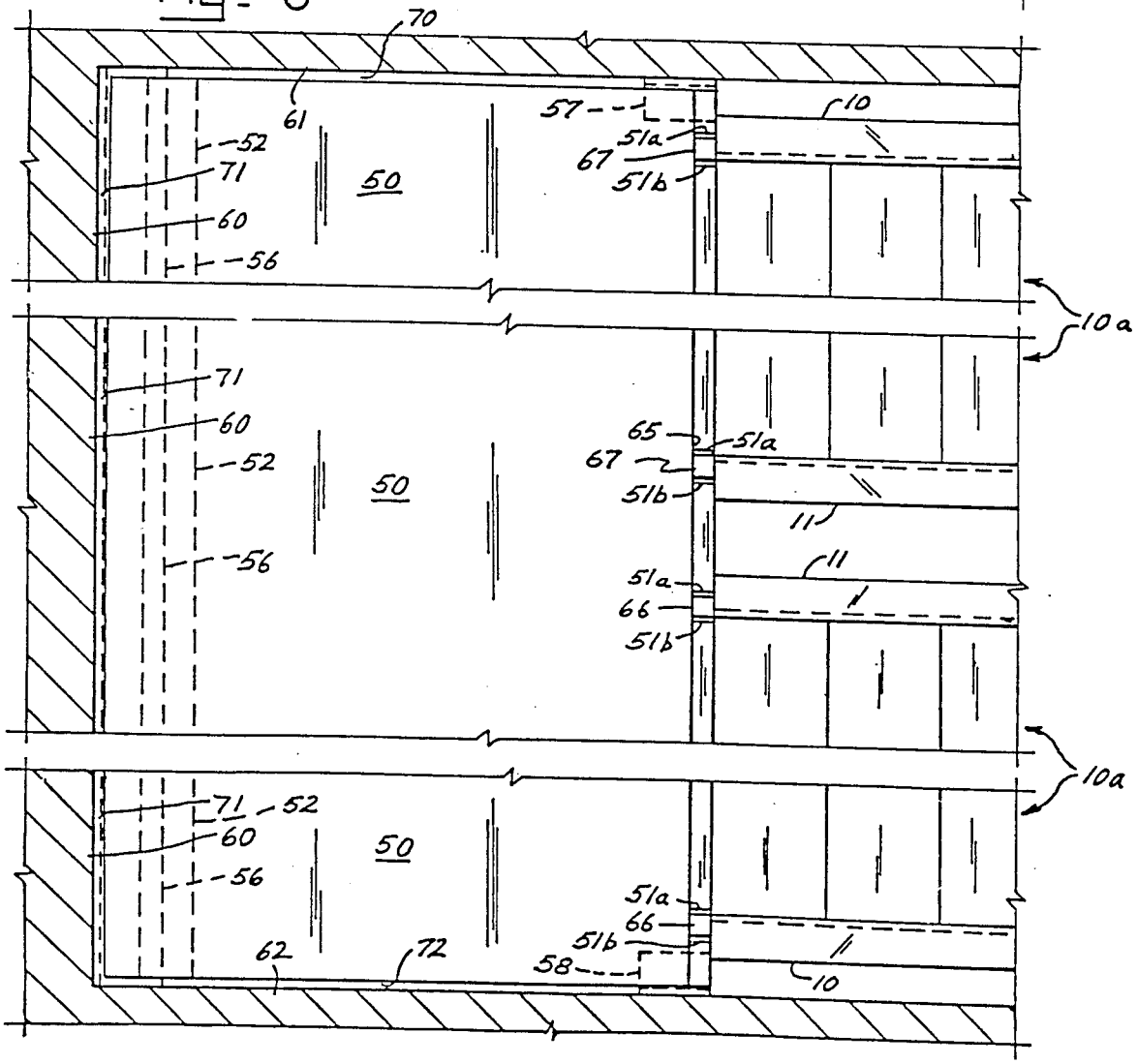
FIG. 6 is a plan view showing the apparatus shown in FIG. 5.
Figure 10:
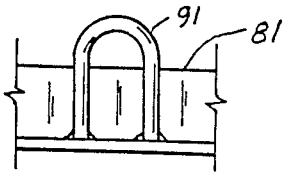
FIG. 10 is a side elevation showing a handling fixture for the apparatus shown in FIGS. 7–9.

Referring now primarily to FIGS. 5–6 of the drawings, the precast concrete landing 50 has steel or other metal insert strips 51 and 52 imbedded therein and anchored by L-shaped anchor rods 53, 54, respectively, which are welded to the metal strips and are anchored into the concrete, as shown, so that the metal strips are strongly fixed in place. The landing 50 is supported by metal angle brackets 56–58. The brackets 56–58 are bolted or pinned or welded to the walls 60–62 of a stairwell therewithin, the bracket 56 being elongated to extend completely across the width of the stairwell, as does the metal strip 52. Alternatively, bracket 56 may be replaced by a plurality of spaced shorter brackets, and metal strip 52 may be replaced by a plurality of spaced shorter strips disposed in the concrete of the landing at the locations of the brackets. Bracket or brackets 56 are welded to strip or strips 52 at 64.

Metal strip 51 extends completely across the inner side of landing 50, in a corner recess 65 of the landing.

Each stair assembly 10*a* has a solid metal bar 66 welded vertically to the angular upper end of each of the channels 10, 11, and has a solid metal bar 67 welded vertically to the angular lower end of each of the channels 10, 11. Bars 66, 67 are each of square cross section, bar 66 extending from the top of the channel end partway down, and bars 67 extending up from the bottom of the channels. The bars may be of any desired lengths, but the lower ends of the bars should be positioned such that they will engage a support to dispose the first tread above or below the lower bar end a proper distance when the stair assembly is installed. As shown in FIG. 5, the first treads 10*b*, 10*c*, of the two stair assemblies 10*a*, 10*a* are about equidistant above and below the upper surface 50*a* of the landing 50, as determined by the lower end positions of bars 66, 67 resting on bar 51 for support of the stair assembly upper and lower ends. The lower ends of bars 66, 67 are welded to bar 51 at 51*a*, 51*b* to stabilize the staircase assembly permanently.

As should by now be clear, the staircase assembly may be installed in a bare stairwell having no provision at its walls of any support assembly. The landings 50 are installed at the proper levels by proper placement of the L-shaped brackets 56–58, the landings being placed on the brackets so that proper spacing exists between the bars 51 upon which the bars 66, 67 of the stair assemblies 10*a* will be supported. Because of the inward extents of the brackets 56–58, a certain amount of leeway is provided for positioning of the landings 50 so that proper bar 51 spacings may be readily obtained. The gaps 70–72 between the stairwell walls 60–62 and the landing 50 may be adjusted in positioning of the landing 50.

The entire staircase assembly is rigidly secured together by the welds 64, 51*a*, 51*b*, so that the staircase is strong, safe and dependable.

The landings 50 are formed of the same concrete mixture as the tread pads, earlier described.

Figure 11:
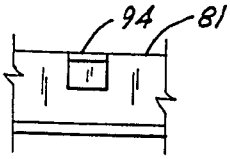
FIG. 11 is a side elevation of a fixture for use in installing an edge spanner for the apparatus.
Figure 12:
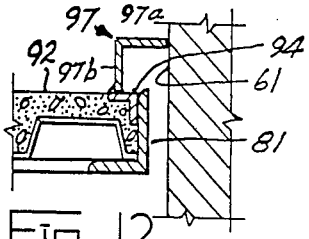
FIG. 12 is a partial cross section showing an edge finishing structure for the platform apparatus.
Figure 7:
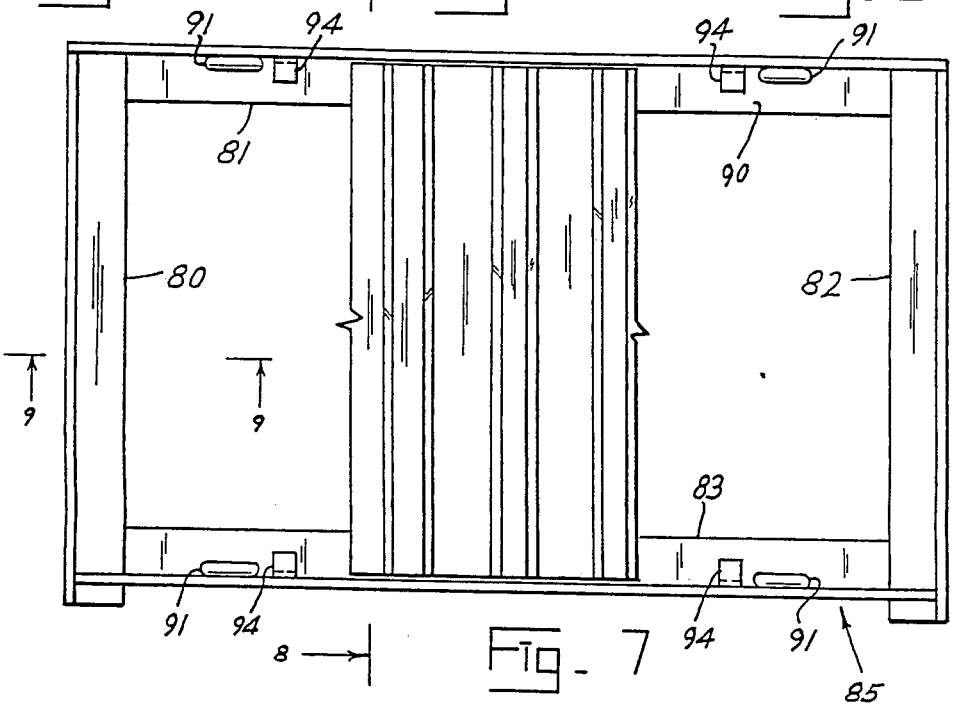
FIG. 7 is a top elevation showing the frame structure for a modified form of platform.
Figure 8:
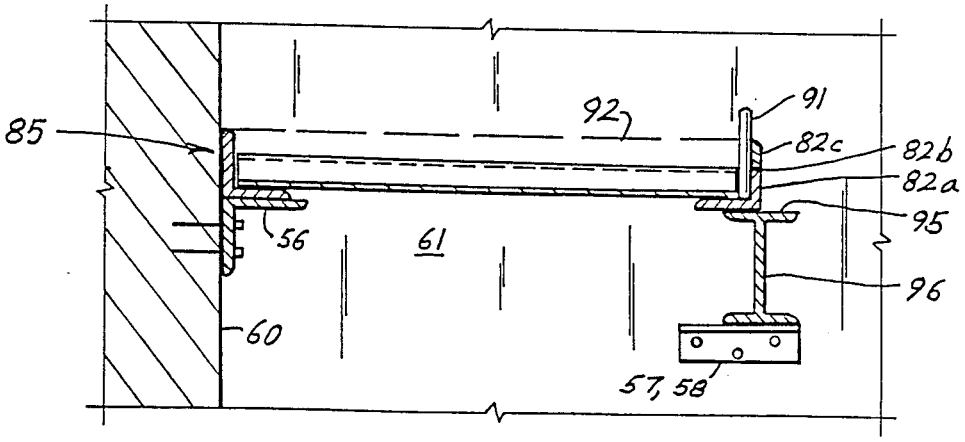
FIG. 8 is a cross section taken at line 8—8 of FIG. 7.
Figure 9:
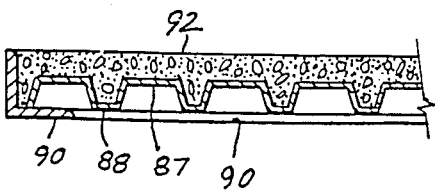
FIG. 9 is a partial cross section taken at line 9—9 of FIG. 7.

Referring now to FIGS. 7–12 of the drawings, an alternative form of landing structure is shown. Four lengths 80–83 of angle irons are trimmed and welded together at their corners to prepare an open bottomed box of shallow depth, the box being referred to by reference numeral 85. The bottom of the box 85 is preferrably formed by a laid in section of corrugated decking, for example one and one half inch type "B" decking, this being laid upon the horizontal reaches of the angle irons 80–83. The decking is formed of relatively thin walled sheet metal shaped as best shown in FIG. 9 to have upper protrusions 87 and lower protrusions 88, the spaces between these protrusions also sometimes being called channels. The decking is laid as shown in FIG. 9 upon the horizontal reaches 90 of the four angle iron pieces. A plurality of U shaped elements 91 are fixed by welding to the horizontal reaches 90 of the angle irons, usually in the position shown in FIG. 7. These are engagable by cable or hook for lifting of the frame both before and after it has been filled with concrete. After the frames filled with concrete have been placed in their ultimate location, the upper portions of the elements 91 above concrete level 92 may be burned or cut off. A plurality of relatively small angle brackets 94 are welded to the interior of each vertical reach of the angle iron pieces 80–83. Only four of these are shown in FIG. 7, but additional angle brackets 94 will be provided on the end angle bars 80, 82. An individual angle bracket 94 is shown in FIG. 11 in elevation. The use to be made of the brackets 94 is illustrated in FIG. 12. The angle bars horizontal portions are at the level 92 at the upper side of the concrete. After the platform has been mounted in place, an angular bar 97 is disposed around frame 85 with its horizontal portion 97*a* engaged with the wall 60, 61, or 62 of the stairwell. The vertical portion 97*b* of bar 97 is then tack welded to the horizontal portion of an angle bracket 94 as illustrated in FIG. 12 to form a closure around the platform or landing. The angle iron 82 has a portion of its vertical portion 82*a* cut off at 82*b* to leave a strip 82*c*. This strip 82*c* is tack welded to the lower portion of angle iron portion 82*a* during pouring of the concrete up to level 92. Thereafter, the strip 82*c* is removed. The purpose of the removal of strip 82*c* is so that when the ends of the stair elements are supported on upper surface 95 of I-beam 96, to be described, the space above the remainder of element 82*a* and between the landing and the top of a staircase can be filled in with concrete more readily in order to provide a seal at each of these locations. As will have become apparent, the landing is supported on an angle bracket strip 56 fixed to the wall 60 of the stairwell in the manner heretofore described. The angle brackets 57, 58 are similarly affixed to walls 61, 62 of the stairwell in the manner previously described, at a level to support a cross I-beam 96, shown in FIG. 8, upon which the landing is disposed for support. The end bars 66, 67 of the stair units are rested upon the top of the I-beam 96, these not being shown in FIG. 8. The lower ends of the bars 66, 67 are welded to the upper side of I-beam 96 in the same manner that they were welded to strip 51 in the earlier embodiment of the landing.

It will be well understood that the invention provides a useful apparatus for use by the construction industry. Through use of the invention, fire stairs and other exterior and interior stairs may be installed without need for pouring the tread and landing concrete at the site of construction in the field. In this way, much construction difficulty and labor time is saved, resulting in cost efficiency, and at the same time an improved stairway structure is obtained. The stair apparatuses according to the invention are stronger, more servicable, and more attractive than those produced by conventional methods. Use of the prescribed concrete mixture results in treads and landings having improved load bearing capacity and impact resistance than those formed of ordinary concrete mixtures. The concrete tread pads are not subject to being loosened or broken during storage, transport, or use of the stair apparatus.

While preferred embodiments of the methods and apparatus according to the invention have been described and shown in the drawings, many modifications thereof may be made by a person skilled in the art without departing from the spirit of the invention; and it is intended to protect by Letters Patent all forms of the invention falling within the scope of the following claims.

We claim:

1. Method for prefabricating complete metal stair assemblies at a site removed from the intended erected location of the stair assemblies, comprising the steps of positioning a pair of stringer elements (10,11) in predetermined spaced relation in a fixture, positioning a plurality of tread pan riser elements (12) each having portions forming a tread pan portion (13) and a frontal flange (14) and an inturned flange (15) and an angular riser (16) and parallel end edges between said stringer elements in said predetermined relation in said fixture, urging at least one of said stringer elements toward the other to establish firm engagement between said end edges of said tread pan riser elements and the adjacent surfaces of said stringer elements, welding said end edges of said tread pan riser elements to said stringer elements while said firm engagement is maintained to provide a rigid dimensionally stable stair frame assembly with said tread pan riser elements forming with said stringer elements a series of upwardly open spaces each being defined by a frontal flange (14) and an inturned flange (15) of a lower one of said plurality of tread pan riser elements and by a tread pan portion (13) and an inwardly sloping portion (16) of one of said angular risers of an upper one of said plurality of tread pan riser elements, pouring a flowable material into each of said open spaces which flowable material being constrained between a portion of said pair of stringer elements and a respective tread pan portion and a respective frontal flange and a respective inturned flange and said inwardly sloped portion of one of said respective angular risers to form durable tread pads upon curing of said flowable material securely constrained within each said respective open spaces to complete said stair assemblies for subsequent delivery to the intended installation site.

2. Method for prefabricating complete metal stair assemblies at a site removed from the intended erected location of the stair assemblies, comprising the steps of positioning a pair of stringer elements (10,11) in predetermined spaced relation in a fixture, positioning a plurality of tread pan riser elements (12) each having portions forming a tread pan portion (13) and a frontal flange (14) and an inturned flange (15) and an angular riser (16) and parallel end edges between said stringer elements while maintaining said stringer elements in said predetermined relation in said fixture, urging at least one of said stringer elements toward the other to establish firm engagement between said end edges of said tread pan riser elements and the adjacent surfaces of said stringer elements, welding said end edges of said tread pan riser elements to said stringer elements while said firm engagement is maintained to provide a rigid dimensionally stable stair frame assembly with said tread pan riser elements forming with said stringer elements a series of upwardly open spaces each being defined by a frontal flange (14) and an inturned flange (15) of a lower one of said plurality of tread pan riser elements and by a tread pan portion (13) and an inwardly sloping portion (16) of one of said angular risers of an upper one of said plurality of tread pan riser elements, coating the interior of said spaces with a bonding agent, placing concrete into said coated spaces before said bonding agent has set, and allowing the concrete to set therein to form concrete tread pads to complete said stair assemblies for subsequent delivery to the intended installation site.

3. Method according to claim 2, wherein said bonding agent is an epoxy resin.

4. Method according to claim 2, wherein said concrete tread pads are poured with wet concrete mixture made with a dry concrete mixture containing sand, stone, a fibrous material, a redispersible copolymer, shrinkage compensated cement, calcium aluminate cement and portland cement.

5. Method according to claim 2, wherein said concrete tread pads are poured with a wet concrete mixture made with a dry concrete mixture containing sand and stone of the customary form used in concrete mixtures, single filament synthetic fiber to increase impact resistance and reduce abrasion of the concrete, redispersible powder based on a vinyl acetate ethylene copolymer as a hydrating agent and to resist alkali degradation of the concrete and to serve as a binder, a shrinkage compensated cement to prevent shrinkage of the concrete within the tread pans, a calcium aluminate cement to add strength to the concrete, and gray portland cement to consolidate the concrete msss.

6. The method according to claim 5, said sand, stone, fiber, redispersible powder, shrinkage compensated cement, calcium aluminate cement, and portland cement being present in said dry concrete mixture in ratios by weight of about 1440:1920:1:12.8:32:64:544, respectively.

* * * * *